US008580475B2

(12) United States Patent
Shoji et al.

(10) Patent No.: US 8,580,475 B2
(45) Date of Patent: Nov. 12, 2013

(54) ELECTROSTATIC CHARGE IMAGE DEVELOPING CARRIER, METHOD OF PRODUCING ELECTROSTATIC CHARGE IMAGE DEVELOPING CARRIER, ELECTROSTATIC CHARGE IMAGE DEVELOPING DEVELOPER, PROCESS CARTRIDGE, IMAGE FORMING APPARATUS, AND IMAGE FORMING METHOD

(75) Inventors: Takeshi Shoji, Kanagawa (JP); Toshiaki Hasegawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 77 days.

(21) Appl. No.: 13/283,017

(22) Filed: Oct. 27, 2011

(65) Prior Publication Data

US 2012/0322004 A1 Dec. 20, 2012

(30) Foreign Application Priority Data

Jun. 20, 2011 (JP) ..... 2011-136075

(51) Int. Cl.
*G03G 9/113* (2006.01)

(52) U.S. Cl.
USPC ..... 430/111.35; 430/111.32

(58) Field of Classification Search
USPC ..... 430/111.35, 111.32
See application file for complete search history.

(56) References Cited

U.S. PATENT DOCUMENTS

| | | | | |
|---|---|---|---|---|
| 5,688,623 | A * | 11/1997 | Nakamura et al. | 430/111.33 |
| 6,100,332 | A * | 8/2000 | Yoshikawa et al. | 525/101 |
| 2010/0068641 | A1* | 3/2010 | Shimmura | 430/105 |
| 2010/0239975 | A1* | 9/2010 | Yamaguchi et al. | 430/111.35 |

FOREIGN PATENT DOCUMENTS

| | | |
|---|---|---|
| JP | A-61-080161 | 4/1986 |
| JP | A-61-080162 | 4/1986 |
| JP | A-05-216283 | 8/1993 |
| JP | A-11-231574 | 8/1999 |

* cited by examiner

*Primary Examiner* — Hoa V Le
(74) *Attorney, Agent, or Firm* — Oliff & Berridge, PLC

(57) ABSTRACT

An electrostatic charge image developing carrier includes a core particle and a coating layer with which the surface of the core particle is coated. The coating layer includes an acrylic resin having a constituent unit in which a silicone chain is disposed in a branch.

21 Claims, 3 Drawing Sheets

ELECTROSTATIC CHARGE IMAGE DEVELOPING CARRIER, METHOD OF PRODUCING ELECTROSTATIC CHARGE IMAGE DEVELOPING CARRIER, ELECTROSTATIC CHARGE IMAGE DEVELOPING DEVELOPER, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-136075 filed Jun. 20, 2011.

BACKGROUND

1. Technical Field

The present invention relates to an electrostatic charge image developing carrier, a method of producing an electrostatic charge image developing carrier, an electrostatic charge image developing developer, a process cartridge, an image forming apparatus, and an image forming method.

2. Related Art

In an electrophotographic method according to the related art, a method of forming an electrostatic charge image on a latent image holding member (photoreceptor) or an electrostatic recording medium by the use of various units and attaching electrometric particles, which are called toner particles, thereto to form the electrostatic charge image is used. In developing an electrostatic charge image, toner particles and carrier particles are mixed and charged by mutual friction to give an appropriate amount of positive or negative charge to the toner particles. Carriers are roughly classified into coated carriers having a coating layer on the surface of a core and non-coated carriers not having a coating layer on the surface thereof. The coated carriers are superior in consideration of the lifetime of a developer.

Various characteristics are demanded for the coated carriers. Particularly, it is necessary to give an appropriate amount of electricity (an appropriate amount of charge or an appropriate charge distribution) to a toner and to maintain the amount of electricity for a long period of time. For this purpose, it is important not to change impact resistance and rub resistance of the carrier and chargeability of the toner even with a change in environment such as temperature and humidity. Therefore, various kinds of coated carriers have been proposed.

SUMMARY

According to an aspect of the invention, there is provided an electrostatic charge image developing carrier including: a core particle; and a coating layer with which the surface of the core particle is coated, wherein the coating layer includes an acrylic resin having a constituent unit in which a silicone chain is disposed in a branch.

BRIEF DESCRIPTION OF THE DRAWINGS

Exemplary embodiments of the present invention will be described in detail based on the following figures, wherein.

DETAILED DESCRIPTION

Figure 1:
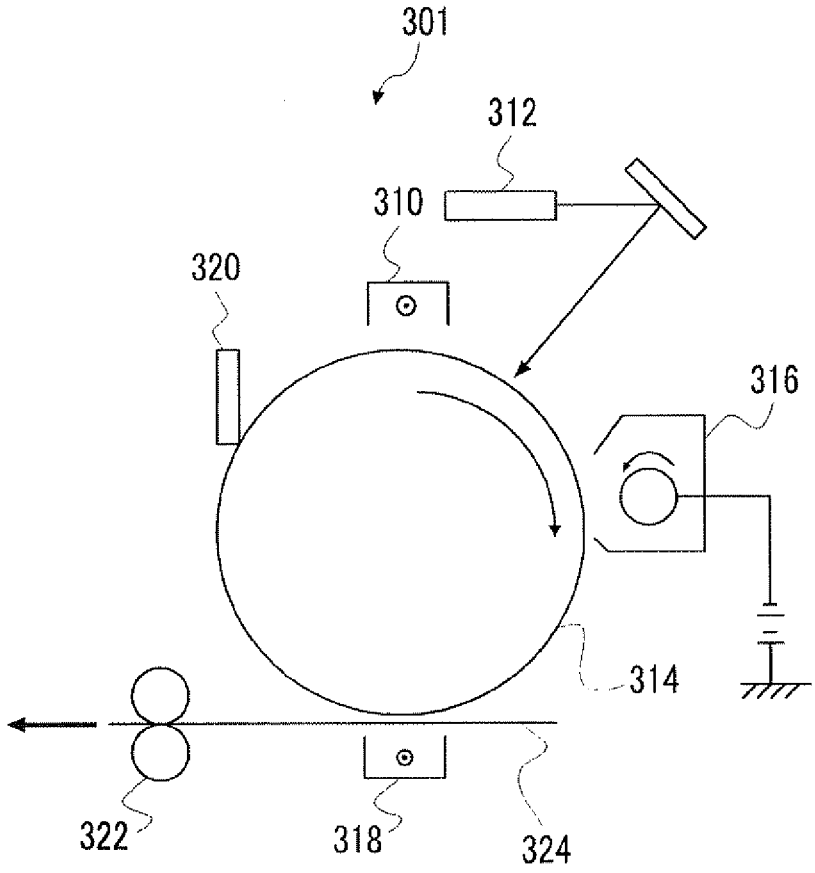
FIG. 1 is a diagram schematically illustrating the configuration of an image forming apparatus according to a first exemplary embodiment of the invention.

Hereinafter, an electrostatic charge image developing carrier, a method of producing an electrostatic charge image developing carrier, an electrostatic charge image developing developer, a process cartridge, an image forming apparatus, and an image forming method according to an exemplary embodiment of the invention will be described in detail.

Electrostatic Charge Image Developing Carrier

An electrostatic charge image developing carrier (hereinafter, also simply referred to as "carrier") according to an exemplary embodiment of the invention is an electrostatic charge image developing carrier including a core particle and a coating layer with which the surface of the core particle is coated, wherein the coating layer includes an acrylic resin having a constituent unit in which a silicone chain is disposed in a branch.

With the recent diversification in the usage of an electrophotographic method, there is a need for the output of an image with various densities. The image with various densities means an image in which a low-density image such as characters and a high-density image such as photographs coexist. Regarding the output of such an image, since the chargeability of a developer is not stabilized, the density of the output image is not stabilized, thereby causing a fall in the output image density. In the output under such a rigorous demands that images are alternately and continuously output under a low-temperature and low-humidity environment of, for example, 10° C. and 12% RH and a high-temperature and high-humidity environment of, for example, 30° C. and 85% RH, the output image density falls markedly.

The inventors successfully suppress the fall of the output image density by using an electrostatic charge image developing carrier of which a coating layer includes an acrylic resin having a constituent unit including a silicone chain disposed in a branch thereof.

The acrylic resin having a constituent unit including a silicone chain disposed in a branch thereof can be obtained, for example, as a reaction product between a (meth)acrylate monomer and an alkoxysilane compound or a polycondensate thereof, probably because the charge exchangeability of the carrier is improved due to the silicone chain originating from the alkoxysilane compound included in the acrylic resin.

Under rigorous output demands where images are alternately and continuously output under a low-temperature and low-humidity environment and a high-temperature and high-humidity environment, as a desirable aspect, the fall of the output image density is successfully suppressed by using a cyclohexyl methacrylate as the (meth)acrylic monomer in a polymerization reaction from which the acrylic resin is obtained. In this case, it is considered that the constituent unit part originating from the cyclohexyl methacrylate contributes low hygroscopicity and chargeability.

Core

The carrier according to this exemplary embodiment is a resin-coated carrier including a core particle and a coating layer coating the core particle with a resin. Examples of the core particles used therein include magnetic metals such as iron, steel, nickel, and cobalt, magnetic oxides such as ferrite and magnetite, and glass beads.

The volume-average particle diameter of the core particles of the carrier according to these exemplary embodiments is preferably in the range of from 10 μm to 500 μm (or from about 10 μm to about 500 μm) and more preferably in the range of from 30 μm to 150 μm.

The volume-average particle diameter of the core is measured, for example, using Coulter Counter Ta-II (made by Beckman Coulter Inc.), Coulter Multisizer II (made by Beckman Coulter Inc.), and a laser-diffraction/scattering particle size distribution meter (LS Particle Size Analyzer: LS13 320 made by Beckman Coulter Inc.). For the size ranges (channels) into which the acquired particle size distribution is divided, a volume accumulation distribution is drawn from the smallest particle diameter and the particle diameter at a 50% accumulation is defined as the volume-average particle diameter.

Coating Layer

The coating layer used in this exemplary embodiment includes an acrylic resin having a constituent unit in which a silicone chain is disposed in a branch.

The acrylic resin (hereinafter, also referred to as a "specific acrylic resin") having a constituent unit in which a silicone chain is disposed in a branch will be described below.

The acrylic resin is preferably a polymer product obtained by a polymerization reaction of a (meth)acrylic monomer and the main chain part of the polymer preferably originates from a (meth)acrylic monomer. A silicone chain originating from an alkoxysilane compound or a polycondensate thereof is preferably coupled to a branch bonded to the main chain originating from the (meth) acrylic monomer of the acrylic resin.

The silicone chain is a polysiloxane part having an Si—O—Si bond.

The specific acrylic resin used in this exemplary embodiment is preferably a resin having a constituent unit expressed by Formula (A).

(A)

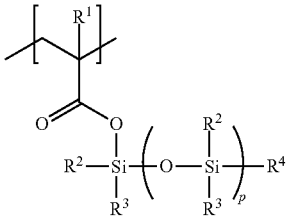

In this formula, $R^1$ represents a hydrogen atom or a methyl group, $R^2$ to $R^4$ each independently represent an alkyl group or an alkoxy group, one of $R^2$ to $R^4$ is bonded to any one of $R^2$ to $R^4$ of another constituent unit expressed by Formula (A) to form an Si—O—Si bond, and p represents an integer.

In Formula (A), $R^1$ is preferably a methyl group. That is, the constituent unit expressed by Formula (A) is preferably a constituent unit originating from a methacrylate compound.

In Formula (A), $R^2$ to $R^4$ each independently represent preferably an alkyl group with a carbon number of 1 to 5 or an alkoxy group with a carbon number of 1 to 5, one of $R^2$ to $R^4$ may be bonded to any one of $R^2$ to $R^4$ of another constituent unit expressed by Formula (A) to form an Si—O—Si bond, and p represents an integer.

In Formula (A), the silicone chain part is preferably introduced from an alkoxysilane compound or a polycondenstate thereof. A tetra-alkoxysilane compound can be preferably used as the alkoxysilane compound and an example thereof is generally used in a sol-gel method.

Specific examples of the tetra-alkoxysilane compound include tetraalkoxysilanes such as tetramethoxysilane, tetraethoxysilane, tetrapropoxysilane, tetraisopropoxysilane, and tetrabutoxysilane, or partial polycondensates thereof. Among these, tetramethoxysilane, tetraethoxysilane, and partial hydrolysis condensates of dimer to decamer thereof can be preferably used. These examples may be used alone or in combination.

In addition to the tetraalkoxysilane compound, a trialkoxysilane compound or a dialkoxysilane compound described below is used.

Specific examples of the trialkoxysilane compound include methyl trimethoxysilane, methyl triethoxysilane, methyl tripropoxysilane, methyl tributoxysilane, ethyl trimethoxysilane, ethyl triethoxysilane, n-propyl trimethoxysilane, n-propyl trietoxysilane, isopropyl trimethoxysilane, isopropyl triethoxysilane, and partial condenstates thereof.

Specific examples of the dialkoxysilane compound include dimethyl dimethoxysilane, dimethyl diethoxysilane, diethyl dimethoxysilane, diethyl diethoxysilane, and partial condensates thereof.

The specific acrylic resin used in this exemplary embodiment is preferably a resin having a constituent unit expressed by Formula (B), in addition to the constituent unit expressed by Formula (A).

(B)

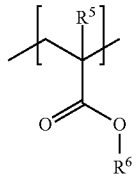

In this formula, $R^5$ represents a hydrogen atom or a methyl group, $R^6$ represents an alkyl group, a cycloalkyl group, an aromatic group, or a heterocyclic group.

In Formula (B), $R^5$ is preferably a methyl group. That is, the monomer unit expressed by Formula (B) is preferably a monomer unit originating from a methacrylate compound.

In Formula (B), $R^6$ is preferably an alkyl group with a carbon number of 1 to 10, a cycloalkyl group with a carbon number of 5 to 12, an aromatic group with a carbon number of 6 to 10, or a heterocyclic group with a carbon number of 6 to 10, more preferably a methyl group, an ethyl group, a propyl group, a butyl group, or a cyclohexyl group, still more preferably a methyl group or a cyclohexyl group, and particularly preferably is a cyclohexyl group.

The constituent unit expressed by Formula (B) originates from a (meth)acrylic monomer which is a starting material of the specific acrylic resin. Specific examples of the monomer include methyl (meth)acrylate, ethyl (meth)acrylate, n-propyl (meth)acrylate, isopropyl (meth)acrylate, n-butyl (meth) acrylate, isobutyl (meth)acrylate, tert-butyl (meth)acrylate, n-hexyl (meth)acrylate, 2-ethylhexyl (meth)acrylate, acetoxyethyl (meth)acrylate, phenyl (meth)acrylate, 2-methoxyethyl (meth)acrylate, 2-ethoxyethyl (meth)acrylate, 2-(2-methoxyethoxy)ethyl (meth)acrylate, cyclohexyl (meth) acrylate, benzyl (meth)acrylate, diethylene glycol monomethyl ether (meth)acrylate, diethylene glycol monoethyl ether (meth)acrylate, diethylene glycol monophenyl ether (meth)acrylate, triethylene glycol monomethyl ether (meth)acrylate, triethylene glycol monoethyl ether (meth)

acrylate, and dipropylene glycol monomethyl ether (meth) acrylate. Methylmethacrylate, ethyl methacrylate, and cyclohexyl methacrylate can be preferably used, methyl methacrylate and cyclohexyl methacrylate can be more preferably used, and cyclohexyl methacrylate can be particularly preferably used.

The specific acrylic resin used in this exemplary embodiment is preferably a resin having a constituent unit expressed by Formula (C), in addition to the constituent units expressed by Formulas (A) and (B).

(C)

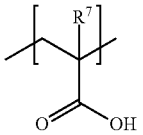

In this formula, $R^7$ represents a hydrogen atom or a methyl group.

In Formula (C), $R^7$ is preferably a methyl group. That is, the constituent unit expressed by Formula (C) is preferably a monomer unit originating from a methacrylate compound.

The specific acrylic resin used in this exemplary embodiment is preferably a resin including constituent units expressed by Formulas (A'), (B'), and (C').

(A')

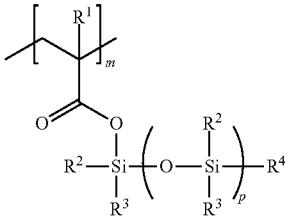

(B')

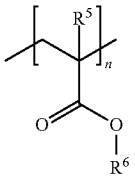

(C')

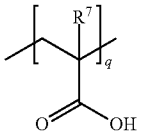

In these formulas, $R^1$, $R^5$ and $R^7$ each independently represent a hydrogen atom or a methyl group, $R^2$ to $R^4$ each independently represent an alkyl group or an alkoxy group, one of $R^2$ to $R^4$ may be bonded to any one of $R^2$ to $R^4$ of another constituent unit expressed by Formula (A') to form an Si—O—Si bond, $R^6$ represents an alkyl group, a cycloalkyl group, an aromatic group, or a heterocyclic group, m and n represent a positive number, q represents 0 or a positive number, and p represents an integer.

In Formulas (A'), (B'), and (C'), $B^1$ to $R^7$ have the same definitions as $R^1$ to $R^7$ in Formulas (A), (B), and (C).

Here, m, n, and q represent 0 or a positive number by which the total sum thereof is 100 wt % in the specific acrylic resin.

The content of the constituent unit expressed by Formula (A') in the specific acrylic resin is preferably equal to or less than 20 wt % (or about 20 wt %) with respect to the total weight of the specific acrylic resin in terms of Si weight and more preferably in the range of from 1 to 20 wt %.

The amount of the constituent unit expressed by Formula (B') in the specific acrylic resin is preferably in the range of from 40 to 95 wt % (or from about 40 to about 95 wt %) with respect to the total weight of the specific acrylic resin used in this exemplary embodiment and more preferably in the range of from 50 to 90 wt %.

The amount of the constituent unit expressed by Formula (C') in the specific acrylic resin is preferably equal to or less than 10 wt % (or about 10 wt %) with respect to the total weight of the specific acrylic resin used in this exemplary embodiment, more preferably equal to or less than 5 wt %, and still more preferably equal to or less than 1 wt %.

An example of a method of synthesizing the specific acrylic resin used in this exemplary embodiment includes the methods of synthesizing compounds described in JP-A-2000-191710 and JP-A-2004-285119. The publications disclose a method of synthesizing a reaction product A which is obtained by transesterification of (a) a (meth)acrylic monomer containing a hydroxyl group and/or a (meth)acrylic oligomer containing a hydroxyl group and (b) a tetraalkoxysilane compound or an alkoxysilane compound including a partial hydrolysis condenstate thereof so that the transesterification rate of an alkoxysilyl group in the component (b) is in the range of from 1 to 50%.

For example, the specific acrylic resin can be commercially available from "COMPOCERAN" series, which are acrylic organic-inorganic hybrid coating materials made by Arakawa Chemical Industries Ltd.

The coating layer of the carrier according to this exemplary embodiment may further include a resin other than the specific acrylic resin, as needed. Examples thereof include polyolefin resins such as polyethylene and polypropylene; polyvinyl or polyvinylidene resins such as polystyrene, acrylic resin, polyacrylonitrile, polyvinyl acetate, polyvinyl alcohol, polyvinyl butyral, polyvinyl chloride, polyvinyl carbazole, polyvinyl ether, and polyvinyl ketone; copolymer of vinyl chloride and vinyl acetate; copolymer of styrene and acrylate; straight silicone resins including an organosiloxane bond or modified products thereof; fludrine resins such as polytetrafluoroethylene, polyvinyl fluoride, polyvinylidene fluoride, and polychlorotrifluoroethylene; polyester; polyurethane; polycarbonate; amino resins such as an urea-formaldehyde resin; and epoxy resins.

The thickness of the coating layer of the carrier according to this exemplary embodiment is preferably in the range of from 0.1 μm to 10 μm (or from about 0.1 μm to about 10 μm) and more preferably in the range of from 0.3 μm to 5 μm.

When the true specific gravity of a core is ρ (dimensionless), the volume-average particle diameter of the core is d (μm), the average specific gravity of the coating layer is $\rho_c$, and the total amount of the coating layer with respect to 100 parts by weight of the core is $W_c$ (part by weight), the average thickness (μm) of the coating layer can be calculated by Expression (11) as follows.

Expression (11):

$$\text{Average Thickness } (\mu m) = \frac{\left\{\left[\frac{\text{Coated Amount per Carrier}\left(\text{including all additives such as conductive powders}\right)}{\text{Surface Area per Carrier}}\right]\right\}}{\text{Average speific gravity of CoatingLayer}}$$

$$= \frac{\left\{\frac{[4/3\pi\cdot(d/2)^3\cdot\rho\cdot Wc]}{[4\pi\cdot(d/2)^2]}\right\}}{\rho_c}$$

$$= (1/6)\cdot(d\cdot\rho\cdot W_c/\rho_c)$$

The volume-average particle diameter of the carrier according to this exemplary embodiment is preferably in the range of from 15 μm to 510 μm.

The volume-average particle diameter of the carrier is measured by the same method as for the volume-average particle diameter of the core.

The total amount of the coating layer in the carrier according to this exemplary embodiment is preferably in the range of from 0.5 part by weight to 10 parts by weight with respect to 100 parts by weight of the core, more preferably in the range of from 1 part by weight to 5 parts by weight, and still more preferably in the range of from 1 part by weight to 3 parts by weight.

For the purpose of charging control or the like, resin particles other than the specific acrylic resin may be used together for the coating layer of the carrier according to this exemplary embodiment. The resin particles are not particularly limited, but resin particles having a charging controllability can be preferably used. Examples thereof include melamine resin particles, urea resin particles, urethane resin particles, polyester resin particles, and acrylic resin particles other than the specific acrylic resin. Among these examples, the melamine resin particles are preferable.

The volume-average particle diameter of the resin particles is preferably in the range of from 50 nm to 1,000 nm and more preferably in the range of from 100 nm to 500 nm.

The amount of the resin particles is preferably in the range of from 5 wt % to 60 wt % with respect to the total weight of the specific acrylic resin in the carrier and more preferably in the range of from 10 wt % to 40 wt %.

An example of the method of measuring sizes of the resin particles is a method of measuring a volume-average particle diameter D50V of the resin particles using a laser-diffraction particle size distribution meter LA-700 (made by Horiba Ltd.).

For the purpose of resistance control, conductive materials such as carbon black may be used together for the coating layer of the carrier according to this exemplary embodiment. In addition to carbon black, examples thereof include metals such as gold, silver, and copper, titanium oxide, zinc oxide, tin oxide, barium sulfate, aluminum borate, potassium titanate, tin oxide doped with antimony, indium oxide doped with tin, zinc oxide doped with aluminum, and resin particles coated with metal.

Method of Producing Electrostatic Charge Image Developing Carrier

The method of producing an electrostatic charge image developing carrier according to this exemplary embodiment is not particularly limited, but preferably includes a process of bringing a solution including an acrylic resin, which has silicone chain as a constituent unit in a branch, into contact with core particles, a process of removing a solvent of the solution to form a coating layer of the acrylic resin on the surfaces of the core particles, and a process of baking the coating layer. The method of producing an electrostatic charge image developing carrier will be described below.

The method of producing an electrostatic charge image developing carrier according to this exemplary embodiment preferably includes a process of bringing a solution including an acrylic resin, which has a silicone chain as a constituent unit in a branch, into contact with core particles.

The solvent used to prepare a specific acrylic resin solution is not particularly limited, as long as it can dissolve the specific acrylic resin. Specifically, aromatic hydrocarbons such as toluene and xylene; ketones such as acetone and methylethyl ketone; ethers such as tetrahydrofuran and dioxane, and the like are used.

Preferable examples of the method of bringing the prepared specific acrylic resin solution into contact with the core include a dipping method of dipping the core particles in the specific acrylic resin solution (hereinafter, also referred to as a coating layer forming solution) to coat the core particles, a spray method of spraying the coating layer forming solution to the surfaces of the core particles, a fluidized bed method of spraying the coating layer forming solution in a state where the core particles are fluidized on a fluidized bed, and a kneader and coater method of mixing the core particles and the coating layer forming solution in a kneader and coater to remove the solvent. The kneader and coater method is particularly preferable. In a preferable example, the specific acrylic resin, the resin particles other than the specific acrylic resin, and the solvent except for the core are dispersed by the use of a homo mixer to prepare a coating layer forming solution, this solution and the core are stirred with a vacuumed aeration kneader maintained at 60° C., the pressure is decreased to 5 kPa, and the solvent is distilled away to form a coating layer.

In the process of removing the solvent of the specific acrylic resin solution to form the resin coating layer on the surfaces of the core particles, the known method of removing the solvent under a depressurized condition is preferably used to form the resin coating layer on the surfaces of the core particles after the removal of the solvent. As in the kneader and coater method, the resin coating layer may be formed in the solvent removing process subsequent to the process of mixing the core particles and the coating layer forming solution.

In the method of producing an electrostatic charge image developing carrier according to this exemplary embodiment, it is preferable that the core particles and the coating layer forming solution are brought into contact with each other, the solvent is then removed, the coating layer is formed on the surfaces of the core particles, and then a baking process is performed. The baking method can employ various known methods and is not particularly limited. The baking temperature is preferably in the range of from 100° C. to 300° C. and more preferably in the range of from 150° C. to 200° C. The baking time is preferably in the range of from 1 to 2 hours. It is considered that the curing of the coating layer further proceeds by this baking process.

Electrostatic Charge Image Developing Developer

The electrostatic charge image developing developer (hereinafter, also simply referred to as a "developer") according to this exemplary embodiment includes the carrier according to this exemplary embodiment and an electrostatic charge image developing toner (hereinafter, also simply referred to as a "toner"). The developer according to this exemplary embodiment is prepared by mixing the carrier according to this exemplary embodiment with the toner at an appropriate mixing ratio. The amount of the carrier (Carrier/(Carrier+Toner)×100) in the electrostatic charge image developing developer is preferably in the range of from 85 wt % to 99 wt %, more preferably in the range of from 87 wt % to 98 wt %, and still more preferably in the range of from 89 wt % to 97 wt %.

Electrostatic Charge Image Developing Toner

The toner used in the electrostatic charge image developing developer according to this exemplary embodiment will be described below.

The toner used in the electrostatic charge image developing developer according to this exemplary embodiment preferably includes a binder resin and a colorant as main components. Examples of the binder resin include homopolymers or copolymers of styrenes such as styrene and chlorostyrene; monoolefins such as ethylene, propylene, butylenes, and isobutylene; vinyl esters such as vinyl acetate, vinyl propionate, and vinyl benzoate; α-methylene aliphatic monocarboxylic esters such as methyl acrylate, ethyl acrylate, butyl acrylate, octyl acrylate, dodecyl acrylate, phenyl acrylate, methyl methacrylate, ethyl methacrylate, butyl methacrylate, and dodecyl methacrylate; vinyl ethers such as vinyl methylether, vinyl ethylether, and vinyl butylether; and vinyl ketones such as methyl vinyl ketone, hexyl vinyl ketone, and isopropenyl vinyl ketone.

Particularly, representative examples of the binder resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, and polypropylene. The examples further include polyester, polyurethane, epoxy resin, silicone resin, polyamide, modified rosin, paraffin, and waxes. Among these examples, polyester can be particularly effectively used as the binder resin. Specifically, a polyester resin including a polycondensate having Bisphenol A and multivalent aromatic carboxylic acid as main monomer components can be preferably used.

The binder resin preferably has a softening temperature in the range of from 70° C. to 150° C., a glass transition temperature in the range of from 40° C. to 70° a number-average molecular weight in the range of from 2,000 to 50,000, a weight-average molecular weight in the range of from 8,000 to 150,000, an acid value in the range of from 5 to 30, and a hydroxyl value in the range of from 5 to 40.

Representative examples of the colorant of the toner include carbon black, nigrosine, aniline blue, calcoil blue, chrome yellow, ultramarine blue, dupont oil red, quinoline yellow, methylene blue chloride, phthalocyanine blue, malachite green oxalate, lamp black, rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3.

The amount of the colorant in the toner is preferably in the range of from 1 to 30 parts by weight with respect to 100 parts by weight of the toner binder resin. A colorant having been subjected to surface treatment or a pigment dispersant may be used effectively as needed. By appropriately selecting the type of the colorant, a yellow toner, a magenta toner, a cyan toner, and a black toner can be prepared.

Examples of the method of producing toner particles include a kneading and pulverizing method of kneading, pulverizing, and classifying a binder resin, a colorant, a release agent, a charging control agent, and the like as needed; a method of changing the shapes of the particles obtained through the kneading and pulverizing method by the use of a mechanical impact force or thermal energy; an emulsification and aggregation method of mixing a dispersion of a colorant, a release agent, a charging control agent, and the like as needed with a dispersion in which the binder resin is emulsified and dispersed and aggregating, heating and fusing the mixture to obtain toner particles; an emulsification, polymerization, and aggregation method of emulsifying and polymerizing polymerizable monomers of a binder resin, mixing a dispersion of a colorant, a release agent, a charging control agent, and the like as needed with the prepared dispersion and aggregating, heating and fusing the mixture to obtain toner particles; a suspension and polymerization method of suspending polymerizable monomers for obtaining a binder resin, a solution of a colorant, a release agent, a charging control agent, and the like as needed in an aqueous medium; and a dissolving and suspension method of suspending and assembling a solution of a binder resin, a colorant, a release agent, a charging control agent, and the like as needed in an aqueous medium for granulation.

A production method of using the toner particles through the above-mentioned method as core particles, attaching resin particles thereto, and heating and fusing the resultant to form a core/shell structure may be performed. The toner according to this exemplary embodiment is preferably a toner (emulsified and aggregated toner) obtained through the use of the emulsification and aggregation method or the emulsification, polymerization, and aggregation method.

External additives such as a fluidizing agent such as silica, titanium dioxide, and alumina, or a cleaning assistant or a transfer assistant such as polystyrene particles, polymethyl methacrylate particles, and polyvinylidene fluoride particles may be added to the toner particles. By adding the external additives to the toner particles, the toner is obtained. Particularly, hydrophobic silica having a primary average particle diameter of from 5 nm to 30 nm is preferably used.

Components of charge control agents such as metal salt salicylate, metal-containing azo compounds, nigrosine, and quaternary ammonium salts or anti-offset agents such as low-molecular weight polypropylene, low-molecular weight polyethylene, and high-molecular alcohol may be added as the additives. Particularly, low-molecular weight polypropylene having a weight-average molecular weight of from 500 to 5,000 can be preferably used.

The average particle diameter of the toner according to this exemplary embodiment is preferably less than 30 μm and more preferably in the range of from 4 μm to 20 μm.

The volume-average particle diameter of the toner particles is measured by the use of Coulter Multisizer II (made by Beckman Coulter Inc.).

The shape factor SF1 of the toner according to this exemplary embodiment is preferably in the range of from 110 to 145, more preferably in the range of from 115 to 140, and still more preferably in the range of from 120 to 135. When the shape factor SF1 is in the range of from 110 to 145, an image with a superior resolution is formed.

The shape factor SF1 is numerically converted mainly by analyzing a microscopic image or a scanning electron microscopic image by the use of an image analyzer, and can be calculated, for example, as follows.

The shape factor SF1 is measured by inputting an optical microscopic image of toner particles scattered on a glass slide to the LUZEX image analyzer through the use of a video camera, calculating SF1 of 50 or more toner particles by the use of the following expression, and averaging the calculated values.

$$SF1=(ML/A)\times(\pi/4)\times 100$$

Here, ML represents the absolute maximum length of the particles and A represents the projection area of the particles.

Image Forming Apparatus, Image Forming Method, and Process Cartridge

An image forming apparatus according to this exemplary embodiment is not particularly limited, but preferably includes a latent image holding member, a charging unit that charges the surface of the latent image holding member, an electrostatic charge image forming unit that forms an electrostatic charge image on the surface of the latent image holding member, a developing unit that develops the electrostatic charge image with the electrostatic charge image developing developer according to this exemplary embodiment to form a toner image, a transfer unit that transfers the developed toner image to a recording medium, and a fixing unit that fixes the toner image transferred to the recording medium. The image forming apparatus according to this exemplary embodiment may include a cleaning unit that removes the toner remaining on the surface of the latent image holding member as needed.

A process cartridge according to this exemplary embodiment is not particularly limited, but preferably used is a process cartridge that is attached to and detached from an image forming apparatus and that includes: at least one selected from a group consisting of a developing unit that contains the electrostatic charge image developing developer according to this exemplary embodiment and that develops an electrostatic charge image formed on the surface of a latent image holding member with the electrostatic charge image developing developer to form a toner image; a latent image holding member; a charging unit that charges the surface of the latent image holding member; and a cleaning unit that removes the toner remaining on the surface of the latent image holding member.

An image forming method according to this exemplary embodiment is not particularly limited, but is preferably an image forming method including a charging process of charging the surface of a latent image holding member, an electrostatic charge image forming process of forming an electrostatic charge image on the surface of the latent image holding member, a developing process of developing the electrostatic charge image with the electrostatic charge image developing developer according to this exemplary embodiment to form a toner image, a transfer process of transferring the developed toner image to a recording medium, and a fixing process of fixing the toner image transferred to the recording medium.

An example of the image forming apparatus according to this exemplary embodiment will be described below, but the invention is not limited to the example.

FIG. 1 is a diagram schematically illustrating the configuration of the image forming apparatus according to a first exemplary embodiment of the invention. The image forming apparatus 301 includes a charging device 310, an exposing device 312, an electrophotographic photoreceptor 314 as the latent image holding member, a developing device 316, a transfer device 318, a cleaning device 320, and a fixing device 322.

In the image forming apparatus 301, the charging device 310 as the charging unit that charges the surface of the electrophotographic photoreceptor 314, the exposing device 312 as the electrostatic charge image forming unit that exposes the charged electrophotographic photoreceptor 314 to form an electrostatic charge image on the basis of image information, the developing device 316 as the developing unit that develops the electrostatic charge image with a developer to form a toner image, the transfer device 318 as the transfer unit that transfers the toner image formed on the surface of the electrophotographic photoreceptor 314 to the surface of a recording medium 324, and the cleaning device 320 as the cleaning unit that removes particles such as the toner remaining on the surface of the electrophotographic photoreceptor 314 after transfer to clean the surface of the electrophotographic photoreceptor 314 are sequentially arranged around the electrophotographic photoreceptor 314. The fixing device 322 as the fixing unit that fixes the toner image transferred to the recording medium 324 is disposed on a side of the transfer device 318.

The operation of the image forming apparatus 301 according to this exemplary embodiment will be described below. First, the surface of the electrophotographic photoreceptor 314 is charged by the charging device 310 (a charging process). Then, light is applied to the surface of the electrophotographic photoreceptor 314 by the use of the exposing device 312 and charged charges of the part to which light is applied are removed to form an electrostatic charge image corresponding to image information (an electrostatic charge image forming process). Thereafter, the electrostatic charge image is developed by the developing device 316 to form a toner image on the surface of the electrophotographic photoreceptor 314 (a developing process). For example, in case of a digital electrophotographic copying machine using an organic photoreceptor as the electrophotographic photoreceptor 314 and using a laser beam as the exposing device 312, negative charges are given to the surface of the electrophotographic photoreceptor 314 by the charging device 310 to form a digital latent image as a dot image by the use of the laser beam and the toner is given to the part to which the laser beam is applied by the use of the developing device 316 to visualize the latent image. In this case, a minus bias voltage is applied to the developing device 316. By the use of the transfer device 318, the recording medium 324 such as a sheet of paper is superimposed on the toner image and charges having polarity opposite to that of the toner are given to the recording medium 324 from the backside of the recording medium 324, whereby the toner image is transferred to the recording medium 324 through an electrostatic force (a transfer process) The transferred toner image is heated and pressurized by a fixing member of the fixing device 322 and is fused and fixed to the recording medium 324 (a fixing process). On the other hand, the particles such as the toner not transferred but remaining on the surface of the electrophotographic photoreceptor 314 are removed by the cleaning device 320 (a cleaning process). The series of processes from the charging process to the image holding member cleaning process are finished as one cycle. In FIG. 1, the toner image is directly transferred to the recording medium 324 through the use of the transfer device 318, but the toner image may be transferred via a transfer medium such as an intermediate transfer medium.

The charging unit, the latent image holding member, the electrostatic charge image forming unit (the exposing unit), the developing unit, the transfer unit, the cleaning unit, and the fixing unit in the image forming apparatus 301 shown in FIG. 1 will be described below.

Charging Unit

For example, a charger such as a corotron shown in FIG. 1 is used as the charging device 310 as the charging unit, but a conductive or semi-conductive charging roll may be used. A contact type charger employing the conductive or semi-conductive charging roll may apply a DC current to the electrophotographic photoreceptor 314 or may superimpose an AC current thereon and apply the resultant thereto. For example, by causing discharge to occur in a minute space around a contact part with the electrophotographic photoreceptor 314 by the use of the charging device 310, the surface of the electrophotographic photoreceptor 314 is charged. In general, the surface of the electrophotographic photoreceptor 314 is charged with the voltage range of from −300 V to −1000 V. The conductive or semi-conductive charging roll may have a single-layered structure or a multi-layered structure. A mechanism cleaning the surface of the charging roll may be further provided.

Latent Image Holding Member

The latent image holding member has at least a function of forming a latent image (an electrostatic charge image) thereon. An electrophotographic photoreceptor is very suitably used as the latent image holding member. The electrophotographic photoreceptor 314 includes a coating film including an organic photoreceptor on the outer circumferential surface of a cylindrical conductive base. In the coating film, an undercoating layer and a photosensitive layer having a charge generating layer including a charge generating material and a charge transport layer including a charge transport material, and the like are sequentially formed on the base as needed. The stacking order of the charge generating layer and the charge transport layer may be reversed. This is a multi-layered photoreceptor in which separate layers (the charge generating layer and the charge transport layer) including the charge generating material and the charge transport material, respectively, are stacked, but a single-layered photoreceptor in which both the charge generating material and the charge transport material are included in the same layer may be used. The multi-layered photoreceptor is preferable. An intermediate layer may be disposed between the undercoating layer and a photosensitive layer. The photosensitive layer is not limited to the organic photoreceptor, but another photosensitive layer such as an amorphous silicon photosensitive film may be used.

Electrostatic Charge Image Forming Unit

The exposing device 312 as the electrostatic charge image forming unit (the exposing unit) is not particularly limited and examples thereof include optical instruments exposing the surface of the latent image holding member with a light source such as a semiconductor laser beam, an LED (Light Emitting Diode) beam, or a liquid crystal shutter beam to form a desired image.

Developing Unit

The developing device 316 as the developing unit has a function of developing a latent image formed on the latent image holding member with a developer including a toner to form a toner image. The developing device is not particularly limited, as long as it has the above-mentioned function, and can be appropriately selected depending on the purpose. Examples thereof include known developing devices having a function of attaching an electrostatic charge image developing toner to the electrophotographic photoreceptor 314 by the use of a brush or a roller. A DC voltage is generally used for the electrophotographic photoreceptor 314, but an AC voltage may be superimposed on the DC voltage.

Transfer Unit

A transfer device giving charges having the opposite polarity to that of the toner to a recording medium 324 from the backside of the recording medium 324 to transfer the toner image to the recording medium 324 by an electrostatic force, as shown in FIG. 1, or a transfer roll and a transfer roll pressing device employing a conductive or semi-conductive roll coming in direct contact with the surface of the recording medium 324 to transfer the toner image can be used as the transfer device 318 as the transfer unit. A DC current may be applied to the transfer roll as a transfer current to be supplied to the latent image holding member, or an AC current may be superimposed thereon and applied thereto. The transfer roll can be arbitrarily set depending on the width of an image area to be charged, the shape of a transfer charger, a passage width, a process speed (circumferential speed), and the like. A single-layered foamed roll is suitably used as the transfer roll for the purpose of a decrease in cost. A type of directly transferring a toner image to a recording medium 324 such as paper or a type of transferring a toner image to a recording medium 324 via an intermediate transfer medium may be employed as the transfer type.

Any known intermediate transfer medium can be used as the intermediate transfer medium. Examples of the material used for the intermediate transfer medium include polycarbonate resin (PC), polyvinylidene fluoride (PVDF), polyalkylene phthalate resin, a blended material of PC/polyalkylene phthalate (PAT), and blended materials such as polyethylene-polytetrafluoroethylene copolymer (ETFE)/PC, ETFE/PAT, and PC/PAT. The intermediate transfer belt formed of a thermosetting polyimide resin is preferable from the viewpoint of mechanical strength.

Cleaning Unit

The cleaning device 320 as the cleaning unit may appropriately employ any of a blade cleaning type, a brush cleaning type, and a roll cleaning type, as long as it can remove and clean the particles such as the residual toner on the latent image holding member.

Fixing Unit

The fixing device 322 as the fixing unit (the image fixing device) serves to fix a toner image transferred to the recording medium 324 by heating, pressurization, or heating and pressurization and includes a fixing member.

Recording Medium

Examples of the recording medium 324 to which a toner image is transferred include regular paper and OHP sheets used in an electrophotographic copying machine or printer. To further improve the smoothness of the surface of a fixed image, the surface of a recording medium is preferably as smooth as possible and, for example, a coated sheet obtained by coating the surface of a sheet of regular paper with a resin or the like or a printing art paper are suitably used.

By combination with the trickle development proposed in JP-B-2-021591, it is possible to stably form an image for a longer period of time.

Figure 2:
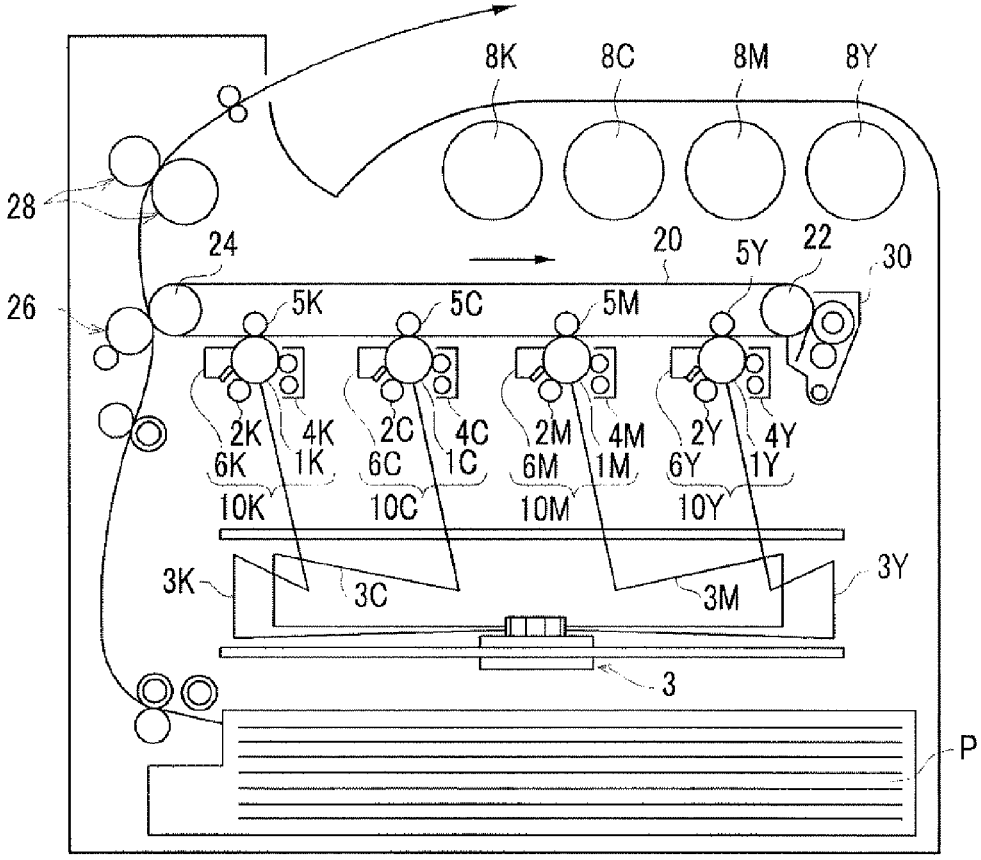
FIG. 2 is a diagram schematically illustrating the configuration of an image forming apparatus according to a second exemplary embodiment of the invention.

FIG. 2 is a diagram schematically illustrating the configuration of a four tandem type color image forming apparatus which is an image forming apparatus according to a second exemplary embodiment of the invention. The image forming apparatus shown in FIG. 2 includes first to fourth image forming units 10Y, 10M, 10C, and 10K (the image forming unit) of an electrophotographic type outputting color images of yellow (Y), magenta (M), cyan (C), and black (K) based on color-separated image data. The image forming units (hereinafter, also simply referred to as "units") 10Y, 10M, 10C, and 10K are arranged at a predetermined interval in the horizontal direction. The units 10Y, 10M, 10C, and 10K may be a process cartridge that is detachable from an image forming apparatus body.

Above the units 10Y, 10M, 10C, and 10K in the drawing, an intermediate transfer belt 20 as the intermediate transfer member extends over the units. The intermediate transfer belt 20 is wound on a driving roller 22 and a support roller 24 coming in contact with the inner surface of the intermediate transfer belt 20, which are separated from each other on the left side and the right side in the drawing, and travels in the direction from the first unit 10Y to the fourth unit 10K. The support roller 24 is impelled in a direction in which it gets apart from the driving roller 22 by a spring not shown or the like and thus a tension is given to the intermediate transfer belt 20 wound on both. An intermediate transfer member cleaning device 30 is disposed on the surface of the intermediate transfer belt 20 facing the image holding member so as to face the driving roller 22.

The developing devices (the developing units) 4Y, 4M, 4C, and 4K of the units 10Y, 10M, 10C, and 10K are supplied with four color toners of yellow, magenta, cyan, and black contained in the toner cartridges 8Y, 8M, 8C and 8K, respectively.

Since the first to fourth units 10Y, 10M, 10C, and 10K have the same configuration, the first unit 10Y for forming a yellow image disposed upstream in the traveling direction of the intermediate transfer belt will be representatively described below. The parts equivalent to those of the first unit 10Y are referenced by reference signs corresponding to magenta (M), cyan (C), and black (K) instead of yellow (Y), and the second to fourth units 10M, 10C, and 10K will not be described.

The first unit 10Y includes a photoreceptor 1Y serving as an image holding member. A charging roller 2Y charging the surface of the photoreceptor 1Y to a predetermined potential, an exposing device (the electrostatic charge image forming unit) 3 exposing the charged surface with a laser beam 3Y based on a color-separated image signal to form an electrostatic charge image, a developing device (the developing unit) 4Y supplying a charged toner to the electrostatic charge image to develop the electrostatic charge image, a primary transfer roller 5Y (the primary transfer unit) transferring the developed toner image to the intermediate transfer belt 20, and a photoreceptor cleaning device (the cleaning unit) 6Y removing the toner remaining on the surface of the photoreceptor 1Y after the primary transfer are sequentially arranged around the photoreceptor 1Y.

The primary transfer roller 5Y is disposed inside the intermediate transfer belt 20 and is located at a position facing the photoreceptor 1Y. The primary transfer rollers 5Y, 5M, 5C, and 5K are connected to bias power sources (not shown) applying a primary transfer bias. The bias power sources vary the transfer bias to be applied to the primary transfer rollers under the control of a control unit not shown.

The operation of forming a yellow image by the use of the first unit 10Y will be described below. Before starting the operation, the surface of the photoreceptor 1Y is charged to a potential of −600 V to −800 V by the charging roller 2Y.

The photoreceptor 1Y has a structure in which a photosensitive layer is stacked on a conductive base (with volume resistivity of $1\times10^{-6}$ Ωcm or less at 20° C.). The photosensitive layer has a characteristic that the resistance is normally high but the resistivity of a part irradiated with a laser beam is changed when the laser beam 3Y is applied thereto. The exposing device 3 outputs the laser beam 3Y to the charged surface of the photoreceptor 1Y on the basis of yellow image data sent from the control unit not shown. The laser beam 3Y is applied to the photosensitive layer on the surface of the photoreceptor 1Y and thus an electrostatic charge image of a yellow print pattern is formed on the surface of the photoreceptor 1Y.

The electrostatic charge image is an image to be formed on the surface of the photoreceptor 1Y by the charging and is a so-called negative latent image which is formed by lowering the resistivity of the irradiated part of the photosensitive layer with the laser beam 3Y to cause charges to flow on the surface of the photoreceptor 1Y and causing the charges to remain in the part not irradiated with the laser beam 3Y.

The electrostatic charge image formed on the photoreceptor 1Y in this way rotates to a predetermined developing position with the rotation of the photoreceptor 1Y. The electrostatic charge image on the photoreceptor 1Y is visualized (changed to a developed image) by the developing device 4Y at the developing position.

For example, an electrostatic charge image developing developer including at least a yellow toner and a carrier is contained in the developing device 4Y. The yellow toner is frictionally charged by the stirring in the developing device 4Y and is held on a developer roller (the developer holding member) with charges having the same polarity (negative polarity) as that of the charges on the photoreceptor 1Y. By causing the surface of the photoreceptor 1Y to pass through the developing device 4Y, the yellow toner is electrostatically attached to a neutralized latent image part on the surface of the photoreceptor 1Y to develop the latent image with the yellow toner.

From the viewpoint of development efficiency, image granularity, and gradation reproducibility, a bias potential (developing bias) in which an AC component is superimposed on a DC component may be applied to the developer holding member. Specifically, when the DC voltage Vdc to be applied to the developer holding member is set to the range of from −300 V to −700 V, the peak width Vp-p of the AC voltage to be applied to the developer holding member may be set to the range of from 0.5 kV to 2.0 kV.

The photoreceptor 1Y having a yellow toner image formed thereon continuously travels at a predetermined speed to carry the developed toner image on the photoreceptor 1Y to a predetermined primary transfer position.

When the yellow toner image on the photoreceptor 1Y is carried to the primary transfer position, the primary transfer bias is applied to the primary transfer roller 5Y and an electrostatic force acting from the photoreceptor 1Y to the primary transfer roller 5Y is applied on the toner image, whereby the toner image on the photoreceptor 1Y is transferred to the intermediate transfer belt 20. The transfer bias applied at this time has the (+) polarity opposite to the polarity (−) of the toner and is controlled to about +10 μA, for example, in the first unit 10Y by the control unit (not shown).

On the other hand, the toner remaining on the photoreceptor 1Y is removed and recovered by the photoreceptor cleaning device 6Y.

The primary transfer biases applied to the primary transfer rollers 5M, 5C, and 5K of the second unit 10M and the subsequent units thereof are controlled similarly to the first unit.

Accordingly, the intermediate transfer belt 20 to which the yellow toner image is transferred in the first unit 10Y is transported sequentially over the second to fourth units 10M, 10C, and 10K and the toner images of the colors are multiply transferred to overlap with each other.

The intermediate transfer belt 20 to which four color toner images are multiply transferred by the first to fourth units reaches a secondary transfer part formed by the intermediate transfer belt 20, the support roller 24 in contact with the inner surface of the intermediate transfer belt 20, and a secondary transfer roller (the secondary transfer unit) disposed on the image holding surface side of the intermediate transfer belt 20. On the other hand, a recording sheet (the recording medium) P is fed to the gap in which the secondary transfer roller 26 and the intermediate transfer belt 20 come in pressing contact with each other at a predetermined time by the use of a feed mechanism and a secondary transfer bias is applied to the support roller 24. The transfer bias applied at this time has the same (−) polarity as the polarity (−) of the toner and an electrostatic force acting from the intermediate transfer belt 20 to the recording sheet P is applied to the toner image, whereby the toner image on the intermediate transfer belt 20 is transferred to the recording sheet P. In addition, the secondary transfer bias is determined depending on the resistance detected by a resistance detector (not shown) detecting the resistance of the second transfer part and is voltage-controlled.

Thereafter, the recording sheet P is fed to a pressed contact part (a nip part) between a pair of fixing rolls in the fixing device (the roll-like fixing unit) 28, the toner images superimposed by colors are heated and melted and fixed to the recording sheet P.

Examples of the recording medium to which a toner image is transferred include regular paper and OHP sheets used, for example, in an electrophotographic copying machine or printer.

The recording sheet P to which a color image is completely fixed is transported to a discharge tray and a series of color image forming operations are finished.

The image forming apparatus has a configuration in which a toner image is transferred to a recording sheet P via the intermediate transfer belt 20, but is not limited to this configuration. The image forming apparatus may have a configuration in which a toner image is transferred directly to a recording sheet from the photoreceptor.

Figure 3:
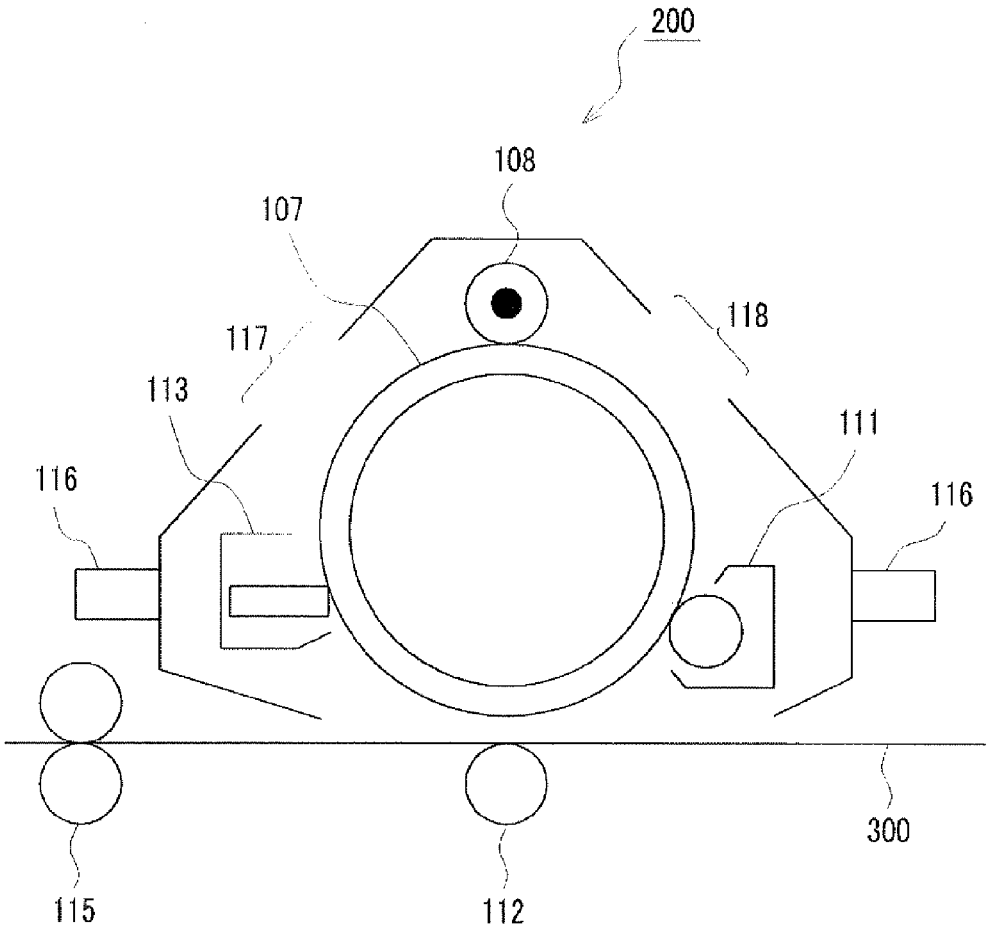
FIG. 3 is a diagram schematically illustrating an exemplary configuration of a process cartridge according to an exemplary embodiment of the invention.

FIG. 3 is a configurational diagram schematically illustrating a suitable example of the process cartridge containing the electrostatic charge image developing developer according to this exemplary embodiment. In the process cartridge 200, a photoreceptor 107, a charging roller 108, a photoreceptor cleaning device 113, an exposure opening 118, and an erasing exposure opening 117 are combined and integrated with a developing device 111 by the use of an attachment rail 116. In FIG. 3, reference numeral 300 represents a recording medium.

The process cartridge 200 can be attached to and detached from an image forming apparatus body including a transfer device 112, a fixing device 115, and other constituent parts not shown and forms the image forming apparatus along with the image forming apparatus body.

The process cartridge 200 shown in FIG. 3 includes the photoreceptor 107, the charging roller 108, the developing device 111, the photoreceptor cleaning device 113, the exposure opening 118, and the erasing exposure opening 117 but these elements may be selectively combined. The process cartridge according to this exemplary embodiment may include at least one element selected from a group consisting of the photoreceptor 107, the charging roller 108, and the photoreceptor cleaning device (the cleaning unit) 113, in addition to the developing device 111.

A toner cartridge will be described below. The toner cartridge is detachably attached to an image forming apparatus and contains at least a toner to be supplied to a developing unit disposed in the image forming apparatus. The toner cartridge accommodates only at least a toner and may contain, for example, a developer depending on a mechanism of the image forming apparatus.

The image forming apparatus shown in FIG. 2 is an image forming apparatus having a configuration in which toner cartridges 8Y, 8M, 80, and 8K can be attached thereto and detached therefrom. The developing devices 4Y, 4M, 4C, and 4K are connected to the toner cartridges corresponding to the developing devices (colors) via toner supply pipes not shown. When each toner cartridge is running short of the toner accommodated therein, the corresponding toner cartridge is replaced.

EXAMPLES

This exemplary embodiment will be described below in more detail with reference to examples and comparative examples, but this exemplary embodiment is not limited to the examples. "part" and "%" are based on weight, as long as they are not differently defined.

Production of Carrier 1

- Ferrite particles (F300 made by Powdertech Co., Ltd., with a volume-average particle diameter of 50 μm): 100 parts
- Toluene: 15 parts
- Specific Acrylic Resin 1 (sample name AC601 made by Arakawa Chemical Industries Ltd.; including methyl methacrylate, Constituent Unit A=8 wt % and Constituent Unit B=80 wt %): 2.5 parts
- Resin Particle 1 (melamine resin particles with an average particle diameter of 100 nm, EPOSTAR FS made by Nippon Shokubai Co., Ltd.): 0.7 part The components other than the ferrite particles are dispersed by the use of a homo mixer for 10 minutes to prepare a solution (hereinafter, also referred to as a coating layer forming solution) for forming a coating layer of a specific acrylic resin, this solution and the ferrite particles are stirred by the use of a vacuum deaeration kneader maintained at 60° C. for 30 minutes, the pressure is decreased to 5 kPa for 60 minutes, toluene is distilled away to form a coating layer, and then the resultant is baked at 120° C. for 2 hours, whereby Carrier 1 is obtained.

The particle sizes are measured by the use of Coulter Multisizer II (made by Beckman Coulter Inc.) and a laser-diffraction/scattering particle size distribution meter (LS Particle Size Analyzer: LS13 320 made by Beckman Coulter Inc.).

Production of Carrier 2

- Ferrite particles (F300 made by Powdertech Co., Ltd.; with a volume-average particle diameter of 50 μm): 100 parts
- Toluene: 15 parts
- Specific Acrylic Resin 2 (sample name HBAC98 made by Arakawa Chemical Industries Ltd.; including cyclohexyl methacrylate, Constituent Unit A=5 wt % and Constituent Unit B=80 wt %): 2.5 parts
- Resin Particle 1 (melamine resin particles with an average particle diameter of 100 nm, EPOSTAR FS made by Nippon Shokubai Co., Ltd.): 0.7 part The components other than the ferrite particles are dispersed by the use of a homo mixer for 10 minutes to prepare a coating layer forming solution, this solution and the ferrite particles are stirred by the use of a vacuum deaeration kneader maintained at 60° C. for 30 minutes, the pressure is decreased to 5 kPa for 60 minutes, toluene is distilled away to form a coating layer, and then the resultant is baked at 130° C. for 1.5 hours, whereby Carrier 2 is obtained.

Production of Carrier 3

- Ferrite particles (F300 made by Powdertech Co., Ltd.; with a volume-average particle diameter of 50 pm): 100 parts
- Toluene: 15 parts
- Methyl methacrylate polymer (MMA Lacquer made by Soken Chemical & Engineering Co., Ltd.): 2.5 parts
- Resin Particle 1 (melamine resin particles with an average particle diameter of 100 nm, EPOSTAR FS made by Nippon Shokubai Co., Ltd.): 0.7 part The components other than the ferrite particles are dispersed by the use of a homo mixer for 10 minutes to prepare a coating layer forming solution, this solution and the ferrite particles are stirred by the use of a vacuum deaeration kneader maintained at 60° C. for 30 minutes, the pressure is decreased to 5 kPa for 60 minutes, and toluene is distilled away to form a coating layer, whereby Carrier 3 is obtained.

Production of Carrier 4

- Ferrite particles (F300 made by Powdertech Co., Ltd.; with a volume-average particle diameter of 50 μm): 100 parts
- Toluene: 15 parts Cyclohexyl methacrylate polymer (CHMA Lacquer made by Soken Chemical & Engineering Co., Ltd.): 2.5 parts Resin Particle 1 (melamine resin particles with an average particle diameter of 100 nm, EPOSTAR ES made by Nippon Shokubai Co., Ltd.): 0.7 part The components other than the ferrite particles are dispersed by the use of a homo mixer for 10 minutes to prepare a coating layer forming solution, this solution and the ferrite particles are stirred by the use of a vacuum deaeration kneader maintained at 60° C. for 30 minutes, the pressure is decreased to 5 kPa for 60 minutes, and toluene is distilled away to form a coating layer, whereby Carrier 4 is obtained.

Production of Toner

Preparation of Colorant Particle Dispersion 1

Cyan pigment: copper phthalocyanine "C.I. Pigment Blue 15:3" (made by Dainichiseika Colour & Chemicals Mfg Co., Ltd.): 50 parts Anionic Surfactant (Neogen SC made by Dai-ichi Kogyo Seiyaku Co., Ltd.): 5 parts Deionized water: 200 parts These components are mixed, are dispersed by the use of ULTRA-TURRAX (homogenizer) made by IKA Laboratory for 5 minutes, and are dispersed by the use of an ultrasonic bath for 10 minutes, whereby Colorant Particle Dispersion 1 with a solid content of 21% is obtained. The volume-average particle diameter, which is measured by the use of a particle size distribution meter LA-700 made by Horiba Ltd., is 160 nm.

Preparation of Release Agent Particle Dispersion 1

Paraffin wax (HNP-9 made by Nippon Seiro Co., Ltd.): 19 parts

Anionic Surfactant (Neogen SC made by Dai-ichi Kogyo Seiyaku Co., Ltd.): 1 part

Deionized Water: 80 parts

These components are mixed in a heat-resistant container, the resultant mixture is reacted to a temperature of 90° C. and stirred for 30 minutes. Then, the solution is made to pass through the Gaulin homogenizer from the bottom of the container, a circulation operation corresponding to three passes is performed under a pressure condition of 5 MPa, then the pressure is raised to 35 Mpa, and an additional circulation operation corresponding to three passes is performed. The resultant emulsion is cooled in the heat-resistant container up to 40° C. or less, whereby Release Agent Particle Dispersion 1 is obtained. The volume-average particle diameter, which is measured by the use of a particle size distribution meter LA-700 made by Horiba Ltd., is 240 nm.

Preparation of Resin Particle Dispersion 1

Oil Layer

Styrene (made by Wako Pure Chemical Industries Ltd.): 30 parts n-butyl acrylate (made by Wako Pure Chemical Industries Ltd.): 10 parts β-Carboxylethyl acrylate (made by Rhodia Nicca Ltd.) 1.3 parts Dodecanethiol (made by Wako Pure Chemical Industries Ltd.): 0.4 part Water Layer 1

Deionized water: 17 parts

Anionic surfactant (DOWFAX 2A1 made by Dow Chemical Co.): 0.4 part

Water Layer 2

Deionized water: 40 parts

Anionic surfactant (DOWFAX 2A1 made by Dow Chemical Co.): 0.05 part

Ammonium peroxodisulfate (made by Wako Pure Chemical Industries Ltd.): 0.4 part

The oil layer components and the components of Water Layer 1 are input to a flask and are stirred and mixed to prepare a monomer emulsion dispersion. The components of Water Layer 2 are input to a reaction container, the atmosphere in the container is replaced with nitrogen, and the container is heated in an oil bath while stirring until the temperature in the reaction system becomes 75° C. The monomer emulsion dispersion is slowly dropped in the reaction container for 3 hours to perform an emulsion polymerization. After the dropping is ended, the polymerization is further continued at 75° C. and the polymerization is stopped after 3 hours, whereby Resin Particle Dispersion 1 is obtained.

Production of Toner 1

Resin Particle Dispersion 1: 150 parts

Colorant Particle Dispersion 1: 30 parts

Release Agent Particle Dispersion 1: 40 parts

Aluminum polychloride: 0.4 part

These components are mixed and dispersed in a stainless flask by the use of the ULTRA-TURRAX made by IKA. Laboratory, and are then heated to 48° C. while agiting the flask by the use of a heating oil bath. The flask is retained at 48° C. for 80 minutes and then 70 parts of Resin Particle Dispersion 1 is added thereto.

Thereafter, the pH in the system is adjusted to 6.0 by the use of a sodium hydroxide aqueous solution with a concentration of 0.5 mol/L, the stainless flask is then hermitically sealed, and the stainless flask is heated to 97° C. and retained for 3 hours while magnetically sealing the stirring shaft to continue stirring. After the end of the reaction, the resultant is cooled at a temperature-falling rate of 1° C./min and a solid-liquid separation is performed by the use of Nutsche suction filtration. The resultant is re-dispersed using 3,000 parts of deionized water at 40° C. and the resultant dispersion is stirred and washed at 300 rpm for 15 minutes. This washing process is repeatedly performed five times and then the solid-liquid separation is performed using No. 5A filter paper by the Nutsche suction filtration. Then, the resultant is continuously vacuum-dried for 12 hours, whereby toner particles are obtained.

Silica ($SiO_2$) particles with a primary average particle diameter of 90 nm having been subjected to hydrophobic surface treatment with hexamethyldisilazane (hereinafter, also referred to as "HMDS") and metatitanic compound particles with a primary average particle diameter of 20 nm which is a reaction product of metatitanic acid and isobutyltrimethoxysilane are added to the toner particles so that the coating ratio on the surfaces of the toner particles becomes 40%, and the resultant is mixed with a Henschel mixer, whereby Toner 1 is produced.

Preparation and Evaluation of Developer 100 parts of each of Carriers 1 to 4 and 6 parts of the toner are mixed to prepare the developers according to Examples 1 and 2 and the developers according to Comparative Examples 1 and 2. The print test is performed using these developers and a modified machine of DocuCentre Color 400 (made by Fuji Xerox Co., Ltd.) and the image quality after printing out 1,000 sheets under a high-temperature and high-humidity environment (30° C. and 85% RH) is evaluated. After printing out 1,000 sheets under a low-temperature and low-humidity environment (10° C. and 12% RH), the image quality after printing out 1,000 sheets under the high-temperature and high-humidity environment (30° C. and 85% RH) is evaluated. An image including both a character part and a photograph part is used as the test image. The grade in which the fall in the image density is clearly observed is evaluated as "C", the grade in which the fall in the image density is narrowly observed is evaluated as "B", and the grade in which the fall in the image density is not observed is evaluated as "A". The evaluation results are described in Table 1.

TABLE 1

| | Type of Carrier | Type of Toner | Output Image Density (high-temperature and high-humidity condition) | Output Image Density (high-temperature and high-humidity/low-temperature and low-humidity conditions) |
|---|---|---|---|---|
| Example 1 | 1 | 1 | A | B |
| Example 2 | 2 | 1 | A | A |
| Comparative Example 1 | 3 | 1 | C | C |
| Comparative Example 2 | 4 | 1 | C | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing carrier comprising:

a core particle; and a coating layer with which the surface of the core particle is coated, wherein the coating layer includes an acrylic resin having a constituent unit in which a silicone chain is disposed in a branch.

2. The electrostatic charge image developing carrier according to claim 1, wherein the acrylic resin further has a constituent unit originating from cyclohexyl methacrylate.

3. The electrostatic charge image developing carrier according to claim 1, wherein the acrylic resin having the constituent unit in which the silicone chain is disposed in the branch is a resin having a constituent unit expressed by Formula (A)

(A)

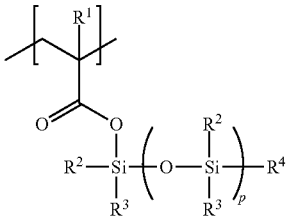

wherein $R^1$ represents a hydrogen atom or a methyl group, $R^2$ to $R^4$ each independently represent an alkyl group or an alkoxy group, one of $R^2$ to $R^4$ may be bonded to any one of $R^2$ to $R^4$ of another constituent unit expressed by Formula (A) to form an Si—O—Si bond, and p represents an integer.

4. The electrostatic charge image developing carrier according to claim 3, wherein $R^1$ in Formula (A) is a methyl group.

5. The electrostatic charge image developing carrier according to claim 3, wherein the silicone chain part in Formula (A) is an alkoxysilane compound or a polycondensate thereof.

6. The electrostatic charge image developing carrier according to claim 5, wherein the alkoxysilane compound is a tetra-alkoxysilane compound.

7. The electrostatic charge image developing carrier according to claim 1, wherein the acrylic resin is a resin further including a constituent unit expressed by Formula (B) in addition to the constituent unit expressed by Formula (A):

(B)

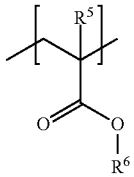

wherein $R^5$ represents a hydrogen atom or a methyl group, $R^6$ represents an alkyl group, a cycloalkyl group, an aromatic group, or a heterocyclic group.

8. The electrostatic charge image developing carrier according to claim 7, wherein $R^5$ in Formula (B) is a methyl group.

9. The electrostatic charge image developing carrier according to claim 1, wherein the acrylic resin is a resin further including a constituent unit expressed by Formula (C) in addition to the constituent units expressed by Formulas (A) and (B):

(C)

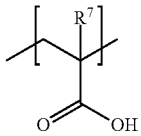

wherein $R^7$ represents a hydrogen atom or a methyl group.

10. The electrostatic charge image developing carrier according to claim 9, wherein $R^7$ in Formula (C) is a methyl group.

11. The electrostatic charge image developing carrier according to claim 1, wherein the acrylic resin is a resin including constituent units expressed by Formulas (A'), (B'), and (C'):

(A')

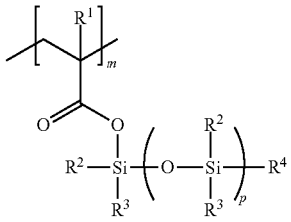

-continued (B')

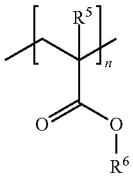

(C')

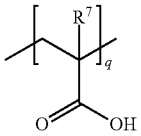

wherein $R^1$, $R^5$, and $R^7$ each independently represent a hydrogen atom or a methyl group, $R^2$ to $R^4$ each independently represent an alkyl group or an alkoxy group, one of $R^2$ to $R^4$ may be bonded to any one of $R^2$ to $R^4$ of another constituent unit (A') to form an Si—O—Si bond, $R^6$ represents an alkyl group, a cycloalkyl group, an aromatic group, or a heterocyclic group, m and n represent a positive number, q represents 0 or a positive number, and p represents an integer.

12. The electrostatic charge image developing carrier according to claim 11, wherein an amount of the constituent unit expressed by Formula A' in the acrylic resin is equal to or less than about 20 wt % with respect to the total weight of the acrylic resin in terms of Si weight.

13. The electrostatic charge image developing carrier according to claim 11, wherein an amount of the constituent unit expressed by Formula (B') in the acrylic resin is in the range of from about 40 to about 95 wt % with respect to the total weight of the acrylic resin.

14. The electrostatic charge image developing carrier according to claim 11, wherein an amount of the constituent unit expressed by Formula (C') in the acrylic resin is equal to or less than about 10 wt % with respect to the total weight of the acrylic resin.

15. The electrostatic charge image developing carrier according to claim 1, wherein a volume-average particle diameter of the core particle of the carrier is in the range of from about 10 μm to about 500 μm.

16. The electrostatic charge image developing carrier according to claim 1, wherein a thickness of the coating layer is in the range of from about 0.1 μm to about 10 μm.

17. A method of producing the electrostatic charge image developing carrier according to claim 1, comprising:

bringing a solution including an acrylic resin into contact with a core particle;

removing a solvent of the solution to form a coating layer of the acrylic resin on the surface of the core particle; and baking the coating layer.

18. An electrostatic charge image developing developer comprising:

the electrostatic charge image developing carrier according to claim 1; and an electrostatic charge image developing toner.

19. A process cartridge that is detachable from an image forming apparatus and that comprises at least one selected from a group consisting of:

a developing unit that contains the electrostatic charge image developing developer according to claim 18 and that develops an electrostatic charge image formed on the surface of a latent image holding member with the electrostatic charge image developing developer to form a toner image;

a latent image holding member;

a charging unit that charges the surface of the latent image holding member; and a cleaning unit that removes the toner remaining on the surface of the latent image holding member.

20. An image forming apparatus comprising:

a latent image holding member;

a charging unit that charges a surface of the latent image holding member;

an electrostatic charge image forming unit that forms an electrostatic charge image on the surface of the latent image holding member;

a developing unit that develops the electrostatic charge image with the electrostatic charge image developing developer according to claim 18 to form a toner image;

a transfer unit that transfers the developed toner image to a recording medium; and a fixing unit that fixes the toner image transferred to the recording medium.

21. An image forming method comprising:

charging the surface of a latent image holding member;

forming an electrostatic charge image on the surface of the latent image holding member;

developing the electrostatic charge image with the electrostatic charge image developing developer according to claim 18 to form a toner image;

transferring the developed toner image to a recording medium; and fixing the toner image transferred to the recording medium.

* * * * *